United States Patent [19]

Basso

[11] Patent Number: 4,517,815

[45] Date of Patent: May 21, 1985

[54] INSULATED MODULAR COOLER

[76] Inventor: Peter J. Basso, 425 Millstone Ct., Rochester, Mich. 48073

[21] Appl. No.: 539,937

[22] Filed: Oct. 7, 1983

[51] Int. Cl.[3] ..... F25D 3/08

[52] U.S. Cl. ..... 62/457; 220/4 C; 220/902

[58] Field of Search ..... 215/6, 12 R; 220/4 C, 220/902; 62/457, 371, 372, 529, 530

[56] References Cited

U.S. PATENT DOCUMENTS

| | | | |
|---|---|---|---|
| 1,434,460 | 11/1922 | Tibbatts | 220/4 C |
| 3,187,518 | 6/1965 | Bair et al. . | |
| 3,190,373 | 6/1965 | Weathersby | 220/4 C |
| 3,255,607 | 6/1966 | Bair et al. . | |
| 3,263,806 | 8/1966 | Ring | 220/902 X |
| 3,703,816 | 11/1972 | Weathers | 62/371 X |
| 3,840,153 | 10/1974 | Devlin . | |
| 3,998,072 | 12/1976 | Shaw . | |
| 4,163,374 | 8/1979 | Moore et al. | 62/457 |
| 4,183,226 | 1/1980 | Moore . | |
| 4,240,271 | 12/1980 | Brownlow . | |
| 4,281,520 | 8/1981 | Norwood . | |
| 4,357,809 | 11/1982 | Held et al. | 62/457 |

*Primary Examiner*—Lloyd L. King

*Attorney, Agent, or Firm*—Gifford, VanOphem, Sheridan, Sprinkle & Nabozny

[57] ABSTRACT

An insulated modular cooler comprising in one embodiment a plurality of tubular housing sections and a plurality of tubular hollow-walled insert housings containing a refrigerant in the hollow walls of the insert housings. The tubular housing sections can be secured end to end to form an elongated tubular body into which the tubular insert housings are slidably received. The cooler further comprises a top end cap adapted to engage the top of the tubular cooler body as well as the top of each individual cooler housing sections, and a lower end cap adapted to engage the bottom of the tubular body as well as the bottom of each individual cooler housing section. Other embodiments are described in which the inserts are integral with the housing sections, in which several inserts are slidably receivable in a single housing section and in which a single insert is slidably received in each modular housing section.

12 Claims, 7 Drawing Figures

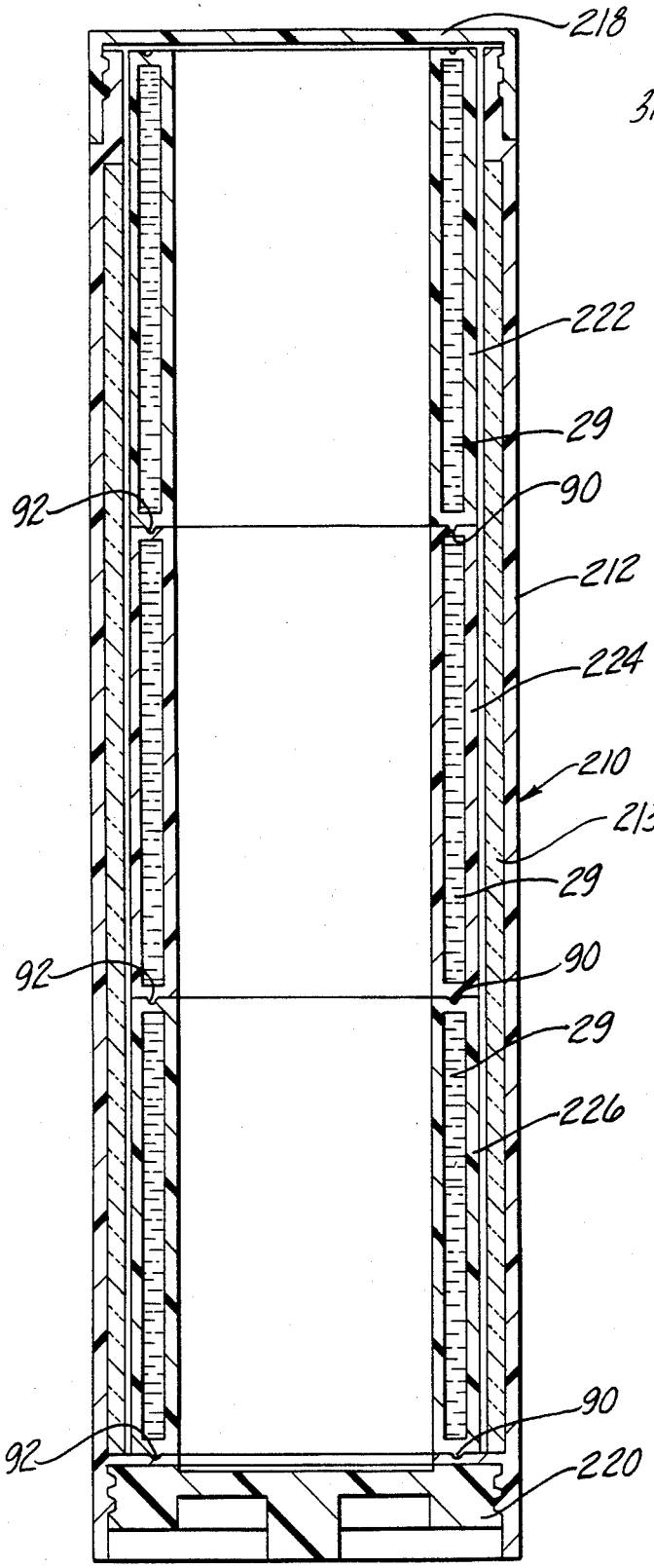
Fig-4
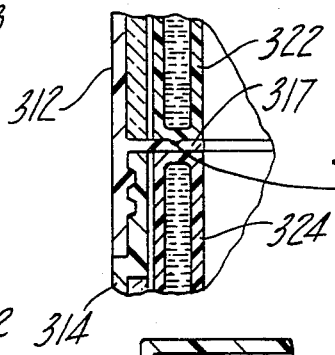
Fig-6
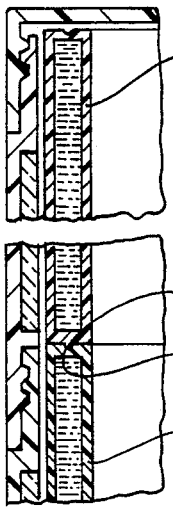
Fig-7
Fig-5
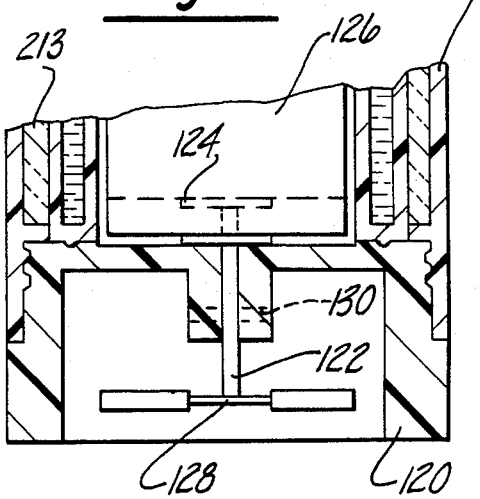

INSULATED MODULAR COOLER

BACKGROUND OF THE INVENTION

1. Field of the Present Invention

The present invention relates generally to storage receptacles and more particularly to a storage receptacle for food products having means for cooling the contents of the receptacle.

2. Description of the Prior Art

There are many previously known types of storage receptacles for cooling and maintaining a low temperature of food products, beverages and the like. Quite often, the receptacles, often commonly referred to as coolers, include an open-topped housing defining a single chamber which can be closed by a housing lid. In such a device, a refrigerant, for example, cubes of ice, is stored in the chamber along with the food products to be stored. Such a structure is disadvantageous for the reason that the ice melts and can soak the food packages or the food products themselves.

Some of the previously known storage receptacles overcome this problem by providing a separate storage area for the refrigerant. However, by doing so, such a device is disadvantageous for the reason that the partition or the means for separating the refrigerant from the food product can inhibit the cooling, and maintenance of low temperatures, of the food product. Moreover, such receptacles suffer the disadvantage that as food products are removed from the container and consumed, the bulk of the container remains substantially the same.

Another previously known means for cooling or maintaining the low temperature of food products comprises a closed housing filled with a refrigerant. The housing itself is inserted within a storage receptacle in order to cool the contents therein. Although such a device prevents the melting refrigerant from contacting the food products within the receptacle, such devices cool not only the food products within the container, but also the ambient air space within the container. Thus, much of the cooling power of the insert is wasted whenever the receptacle is opened and the heat from the ambient air escapes into the open top of the container.

Another previously known refrigerant device is disclosed in U.S. Pat. No. 4,183,226 to Moore. Moore discloses an open-topped insulated beverage can holder adapted to receive a cylindrical sleeve of reusable refrigerant. The cylindrical sleeve can be placed in a conventional refrigerator/freezer to freeze a gel contained within the cylindrical sleeve and which then surrounds a beverage can inserted within the holder to chill and maintain a low temperature in the contents of the container. The device of Moore is disadvantageous for the reason that the beverage container cannot be wholly enclosed within the holder, and thus a portion of the beverage container is exposed to the ambient air. Thus a portion of the chilling effect from the cylindrical sleeve can be wasted, especially when environmental temperature is relatively high. Moreover, the device of Moore is particularly configured for holding a single beverage container and thus does not teach or suggest a means for storing a plurality of beverage containers or other food products within the holder.

SUMMARY OF THE PRESENT INVENTION

One embodiment of the present invention overcomes the above-mentioned disadvantages by providing an insulated modular cooler having a plurality of detachable housing sections, each section comprising a tubular member having hollow walls and containing a refrigerant in the hollow walls. The sections are attached end to end so as to provide one or more cooled compartments adapted to fully enclose the beverage containers or other food products therein. Moreover, as food products contained in each section are consumed, the section can be detached from the remaining sections so as to reduce the bulk of the cooler as the contents are consumed.

In the preferred embodiment, the cooler comprises a plurality of tubular members, each member including an integral insert and a layer of insulating material. A first end of each tubular member includes means for attaching an end cap, and the other end includes an elongated sleeve adapted to receive an end cap therein. Preferably, the first end of the container is particularly configured to fit within the lower end of an adjacent cooler section so that a series of tubular members can be interconnected to form an elongated cooler having an elongated cooling chamber.

In another preferred embodiment, a single tubular member is provided and a plurality of hollow-walled tubular inserts are particularly configured to be slidably received within the chamber of the tubular member.

In each of these embodiments, the hollow walls of the inserts contain a gel, which freezes when placed in a conventional freezer compartment. Preferably, the inner bore of the insert is sized to slidably receive but closely engage the outer periphery of a conventional beverage container. Accordingly, a minimum of air space separates the beverage container to be cooled from the refrigerant.

Other embodiments of the present invention will be described. These include a cooler similar to the first preferred embodiment but in which the tubular inserts are removable from the tubular members and an embodiment similar to this but with means for separating the tubular inserts so that they are not stacked one upon the other within the modular tubular members.

Thus the present invention provides an insulated modular cooler for cooling, or maintaining a low temperature, of food products and particularly canned beverages, in an effective manner. Moreover, the cooler size can be varied to accomodate any number of food products or beverage containers desired. In addition, in several of the embodiments, each separate section of the cooler can be removed so that the food products or beverage containers continue to be cooled while the beverage is being consumed. Furthermore, the cooling inserts and tubular members can be repeatedly used, and they avoid contamination of the food products when the refrigerant melts by maintaining refrigerant in a closed chamber. Nevertheless, the insulated container walls avoid losses of the cooling air to the ambient air outside the cooler and maintain the cold air within the cooler chamber.

BRIEF DESCRIPTION OF THE DRAWINGS

The present invention will be more clearly understood by reference to the following detailed description of several preferred embodiments of the present invention, when read in conjunction with the accompanying drawings in which like reference characters refer to like parts in all views, and in which:

FIG. 4 is a view similar to FIG. 1 but illustrating another preferred embodiment of the present invention;

FIG. 5 is a preferred modification of the bottom end of the device of the present invention;

FIG. 6 is a fragmentary cross-sectional view illustrating another preferred embodiment of the present invention; and FIG. 7 is a view similar to FIG. 6 but illustrating yet another preferred embodiment of the present invention.

DETAILED DESCRIPTION OF THE PREFERRED EMBODIMENT OF THE PRESENT INVENTION

Figure 1:
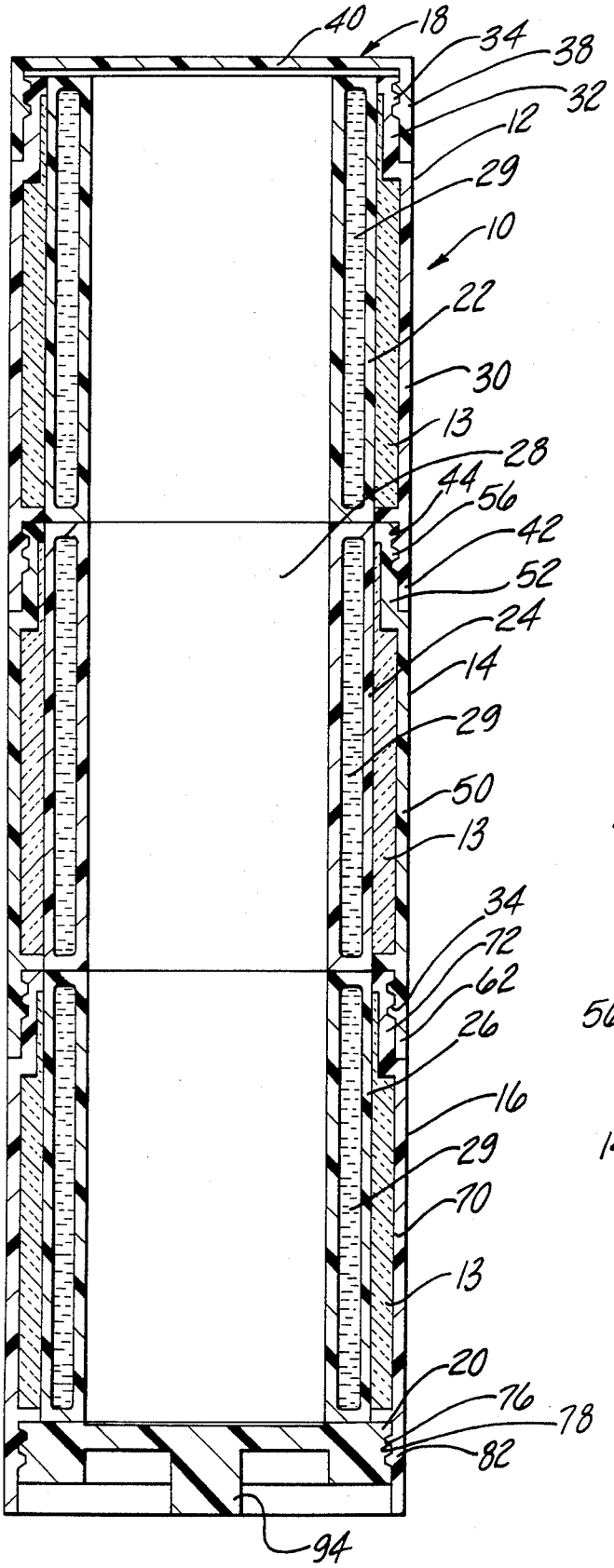
FIG. 1 is a sectional, elevational view of a preferred cooler constructed in accordance with the present invention.
Figure 3:
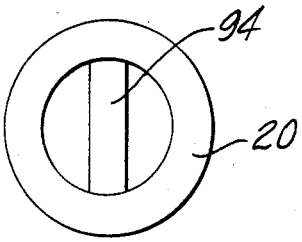
FIG. 3 is an elevational view as seen from the bottom of FIG. 2.
Figure 2:
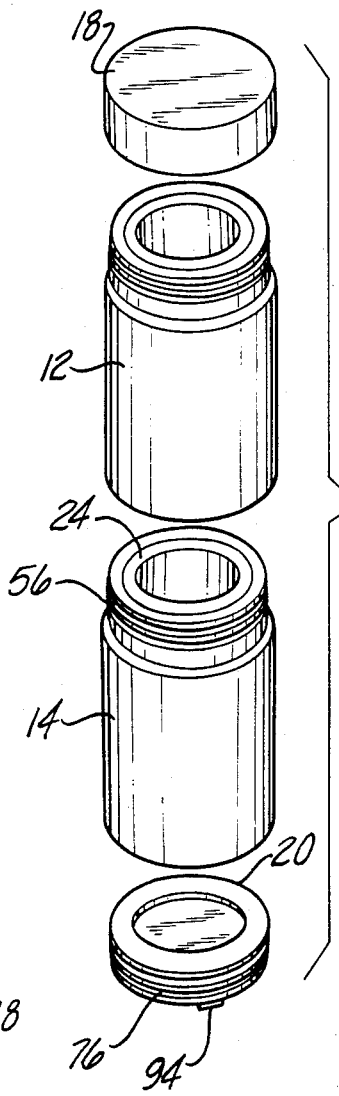
FIG. 2 is an exploded perspective view of the cooler shown in FIG. 1 with one section removed to illustrate an advantageous feature of the invention.

Referring now to the drawing, one preferred embodiment of the present invention is shown in FIGS. 1, 2 and 3 as comprising a cooler 10. The cooler 10 preferably comprises cooler housing sections 12, 14 and 16 as illustrated in FIG. 1. The cooler housing sections 12, 14 and 16 are identical, but are designated separately in the drawing for the sake of clarity in identifying the positions of the sections in the preferred embodiment. In any event, it is to be understood that it is within the scope of the present invention to use any number of housing sections to form the cooler of the present invention. In addition, the cooler 10 includes a top cap 18 and a bottom cap 20.

The cooler housing sections 12, 14 and 16 each comprises an insert housing 22, 24 and 26 respectively. The inner bores of the tubular insert housings 22, 24 and 26 communicate end to end so as to form a central cooling chamber 28 throughout the cooler 10. The annular walls of each of the insert housings 22, 24 and 26 define a hollow annular chamber within each insert housing body. The closed chambers are filled with a gel 29, water or other refrigerant which can be frozen when the insert housing is placed in a conventional freezer or other cooling apparatus. The insert housings 22, 24 and 26 are identical, but are separately designated for clarity in defining the position of the insert housings within the cooler 10.

Referring now to FIG. 1, the cooler housing section 12 also includes a tubular wall 30 integrally formed with or otherwise attached or bonded to the insert 22. Insulation 13 is provided between the wall 30 and the insert 22. One end of the tubular wall 30 includes a recessed, tubular end portion 32. The recessed end portion 32 includes external threads 34 adapted to mate with corresponding internal threads on the sleeve wall portion 38 of cap member 18. Thus, the end wall portion 40 of the cap 18 closes the top of the cooler chamber 28. In addition, the other end of the tubular wall 30 includes an extended sleeve portion 42. The sleeve portion 42 includes internal threads 44 adapted to mate with external threads 56 on a recessed tubular wall portion 52 of the tubular wall 50 of cooler housing section 14. Similarly, an elongated sleeve portion 62 at the other end of the housing 14 engages the recessed tubular end portion 72 of tubular housing wall 70 of cooler housing section 16. In addition, an elongated sleeve portion 82 of the tubular wall 70 includes internal threads 78 corresponding to external threads 76 on the outer periphery of the end cap 20.

In the preferred embodiment illustrated in FIG. 1, the cooler 10 is cylindrical, in cross-section and end caps 18 and 20 are cylindrical. Accordingly, the threaded connections are convenient for attaching the end caps 18 and 20 to the housing sections 12, 14 and 16 and provide an efficient means for sealing the ends of the container 10. Nevertheless, it is to be understood that the cooler body need not be cylindrical to be within the scope of the present invention, and that other means for securing end caps 18 and 20 in place, such as a tongue and groove arrangement, are also within the scope of the present invention.

Nevertheless, it will be understood that since the cooler housing sections 12, 14 and 16 are substantially identical, the end caps 18 and 20 can be secured to the top and bottom, respectively, of any cooler housing section. Thus, as shown in FIG. 2, when a beverage container or other food products have been removed from a portion of the cooler chamber 28 within cooler housing section 12, section 12 can be removed from the top of the cooler housing section 14, and the cap 18 can be secured directly to the top of the cooler housing section 14. A grip portion 94 is provided on the end cap 20 to facilitate tightening the cap 20 in place.

As shown in FIG. 1, the housing sections 12, 14 and 16 have an axial length substantially the same as the length of the conventional beverage can, so that substantially the entire cylindrical periphery of the beverage can is enclosed within and subjected to the cooling effect of the refrigerant within the insert housing. Nevertheless, it is to be understood that variations in the length and breadth of the insert housing, as well as the cooler housing sections, can be adjusted as desired and still remain within the scope of the present invention. However, the corresponding length between the insert housing and the cooler housing sections is advantageous for the reason that entire sections of the cooler can be removed when desired without effecting the cooling capacity of the remaining cooler body.

In addition, a removed section can also be used to cool a beverage container while the beverage is being consumed. To facilitate the use of a removed housing section 16 to accommodate a beverage can, the bottom cap 20 of FIGS. 1, 2 and 3 can be replaced by the end cap 120 shown in FIG. 5. The end cap 120 includes a plunger 122 which can be moved upwardly to move a platform 124 against the bottom of a beverage can 126 to move the top of the can 126 above the top of the housing 16 (not shown). This positions the can 126 so that its contents can be more readily removed for consumption. The plunger 122 has a cross bar 128 to be received in a slot 130 to lock the platform 124 in the upper position.

FIG. 4 illustrates a preferred embodiment similar to the embodiment shown in FIG. 1 except that unlike the embodiment of FIG. 1, the cooler 210 of FIG. 4 consists of a single cooler housing section 212. The housing section 212 is shown as cylindrical and receives a plurality of removable insert sections 222, 224 and 226. It is apparent that the housing sections 212 could be in shapes other than cylindrical if so desired. Insulation 213 is provided between the wall 212 and the insert sections 222, 224, and 226. The individual inserts 222, 224 and 226 can be removed to permit the gel 29 to be frozen. Caps 218 and 220 close the ends of the housing 212.

Mating tongues 90 and grooves 91 are provided in the tubular insert sections 222, 224 and 226 to facilitate stacking of the insert sections in the cooler section 210.

Further embodiments of the present invention are illustrated in FIGS. 6 and 7. The FIG. 6 embodiment is similar to the cooler shown in FIG. 1 except that the insert housings 322, 324 and 326 (not shown) are not integral with or attached to the housing sections 312, 314 and 316 (not shown) but rest upon an inwardly extending flange portion 317 found in each of the housings.

A tongue and groove arrangement 390 between the bottom of the insert housings 322, 324 and 326 (not shown) and the top of the flange portion 317 facilitates proper positioning of the insert housings within the housing sections 312, 314 and 316 (not shown).

The embodiment illustrated in FIG. 7 is similar to the embodiment shown in FIG. 6 except the insert housings 422, 424 and 426 (not shown) are formed with tongue 490 and grooves 492 and are stacked one upon the other.

Thus it can be seen that the preferred embodiment of the present invention provides an insulated modular cooler having modular sections which can be added or subtracted as desired, but which fully encloses the food products or beverage containers therein. Moreover, in several of the embodiments the sections can be interchanged at any position desired and the end caps used for closing the tubular body can be attached to any individual cooler housing section. Thus, it will be understood that an individual cooler housing section could be provided with an additional lower end cap 120 so that the individual section can be used to hold and chill a beverage container within the housing even while the beverage is being consumed. Nevertheless, when an individual cooler housing section has been removed from the remaining cooler housing sections, the remaining housing sections can still be closed by the top and bottom end caps.

Furthermore, it can be seen that in the embodiments of FIGS. 4, 6 and 7, the insert housing sections can be easily slid outwardly from the cooler body and stacked or otherwise placed in a refrigerator compartment for freezing of the refrigerant within the insert housing. Once the refrigerant is frozen, the insert housings are then inserted into the cooler body so that they are stacked end to end, one on top of the other (except of course the embodiment shown in FIG. 6), until they fill the entire cooler body. Nevertheless, as the refrigerant melts while chilling the contents of the cooler chamber, the refrigerant remains separated from the food products or beverage containers and remains sealed within the tubular insert housing.

The pop-up type bottom shown in FIG. 5 is useful with the embodiment of FIGS. 1, 6 and 7 and permits an individual insert to be used while consuming a single can of beverage.

Having thus described the present invention, many modifications thereto will become apparent to those skilled in the art to which it pertains without departing from the scope and spirit of the present invention as defined in the appended claims.

What is claimed is:

1. A receptacle for storing and cooling food products comprising:

a tubular body having an open-ended body chamber comprising at least one first tubular member defining an open-ended chamber, at least one annular housing in said at least one tubular member, said housing having inner and outer wall portions spaced apart from each other to form a hollow chamber therebetween and means for closing the axial ends of said hollow chamber, each said at least one annular housing defining a cavity having open ends;

a layer of insulating material between each said first tubular member and each said annular housing, detachable closure means for closing each open end of said tubular body, and wherein said hollow chamber is filled with a freezeable refrigerant.

2. The invention as defined in claim 1 wherein said tubular body comprises at least two first tubular members and means for detachably securing an end of at least one of said two tubular members to an end of at least one other of said tubular members;

whereby said open-ended chambers of each said tubular member form an elongated open-ended cooling chamber.

3. The invention as defined in claim 2 wherein said tubular body comprises at least three first tubular members: an upper tubular member, a lower tubular member and at least one intermediate tubular member.

4. The invention as defined in claim 1 wherein said closure means comprises a first end cap and a second end cap.

5. The invention as defined in claim 4 wherein each tubular member comprises one end having first means adapted to secure said first end cap to said tubular member, the other end of said tubular member having second means adapted to secure said second end cap to said tubular member.

6. The invention as defined in claim 5 wherein said second means comprises an elongated sleeve portion.

7. The invention as defined in claim 1 wherein a plurality of said tubular members are stacked end to end in said tubular body.

8. The invention as defined in claim 1 wherein said freezable refrigerant is water.

9. The invention as defined in claim 4 and including means provided in at least one of said end caps and adapted to extend into said tubular body to move a beverage can carried therein upwardly with respect to said tubular body.

10. The invention as defined in claim 1 wherein each said at least one annular housing is integrally constructed with a said first tubular member.

11. The invention as defined in claim 1 wherein each said at least one annular housing is in the form of a second tubular member adapted to be slidably received within said tubular body.

12. The invention as defined in claim 11 wherein said each said at least one first tubular member receives at least two said second tubular members.

* * * * *

UNITED STATES PATENT AND TRADEMARK OFFICE

CERTIFICATE OF CORRECTION

PATENT NO. : 4,517,815

DATED : May 21, 1985

INVENTOR(S) : Peter J. Basso

It is certified that error appears in the above-identified patent and that said Letters Patent is hereby corrected as shown below:

Please change zip code from "48073" to --48063--.

Signed and Sealed this

*Eighteenth* Day of *February 1986*

[SEAL]

*Attest:*

DONALD J. QUIGG

*Attesting Officer*

*Commissioner of Patents and Trademarks*